US005303888A

United States Patent [19]

Seop

[11] Patent Number: 5,303,888

[45] Date of Patent: Apr. 19, 1994

[54] GOLF BAG WITH SUPPORT STAND

[76] Inventor: Maeng Seop, Hanyang Apt. 22-102, Songpa-Dong, Songpa-Ku, Seoul, Rep. of Korea

[21] Appl. No.: 16,512

[22] Filed: Feb. 11, 1993

[30] Foreign Application Priority Data

Aug. 4, 1992 [KR] Rep. of Korea ..... 14605/1992

[51] Int. Cl.[5] ..... A63B 55/00

[52] U.S. Cl. ..... 248/96; 206/315.6; 206/315.7

[58] Field of Search ..... 248/96, 136; 206/315.3, 206/315.6, 315.7

[56] References Cited

U.S. PATENT DOCUMENTS

| | | | |
|---|---|---|---|
| 1,681,225 | 8/1928 | Earl | 248/96 |
| 2,661,174 | 12/1953 | Sands | 248/96 |
| 4,087,068 | 5/1978 | Gardner | 248/96 |
| 4,685,561 | 8/1987 | Reimers | 248/96 X |
| 4,746,014 | 5/1988 | Very | 206/315.6 |
| 4,915,221 | 4/1990 | Spangler | 206/315.6 |
| 5,082,218 | 1/1992 | Hoffman | 248/96 |
| 5,096,148 | 5/1992 | Quellais et al. | 248/96 |
| 5,154,377 | 10/1992 | Suk | 248/96 |
| 5,156,366 | 10/1992 | Anderson | 248/96 |
| 5,178,273 | 1/1993 | Igarashi | 248/96 X |

*Primary Examiner*—David A. Scherbel
*Assistant Examiner*—Derek J. Berger
*Attorney, Agent, or Firm*—Schmeiser, Morelle & Watts

[57] ABSTRACT

A golf bag with stand having legs being capable of being automatically extended by weight of golf clubs received in the golf bag when the golf bag stands in inclined position and also being automatically retracted by weight the golf clubs when the golf bag is carried and transported in horizontal position. The golf bag a golf bag body having an opening, a pair of hinge members mounted on a position close to the opening, a pair of legs pivotally mounted on the hinge members at bent ends thereof, a pair of arms which are mounted on the bent ends of the legs at lower ends thereof and have head portions at upper ends thereof, respectively, a pair of connecting links which are connected to the head portions of the arms at one ends thereof and disposed inside of the golf bag body at the other ends thereof, and a case for receiving golf clubs which is fixed to an inner surface of the body at one end thereof and connected to the head portions of the arms at the other end thereof, the other end being movable upwards and downwards. The golf bag may also have a hook mounted on an end of the golf bag and a connecting strap connected to the head portions of the arms at one end thereof and selectively connected to the hook at the other end thereof.

9 Claims, 3 Drawing Sheets

GOLF BAG WITH SUPPORT STAND

BACKGROUND OF THE INVENTION

1. Field of the Invention

The present invention relates to golf bags with support stand, and more particularly to golf bags with support stand wherein a pair of legs are movable between their extended position and their retracted position by ascending and descending movement of case mounted therein for receiving golf clubs as result of weight of golf clubs.

2. Description of the Prior Art

Conventionally, there have been proposed various golf bags which have stands for standing the golf bags in their inclined positions. For example, such type of golf bags are disclosed in U.S. Pat. Nos. 4,506,854, 4,676,464 and 4,921,192 and Korean Utility Model Application Nos. 90-2102, 90-5195, 90-9915, 91-6800 and 91-6801, the Korean applications being filed by the present applicant. The golf bags disclosed in the above-mentioned patents and applications have stands for standing the golf bags in their inclined positions.

However, since the above-mentioned golf bags must be inevitably provided with complicate and expensive actuating members between the golf bags and their legs in order to extend and retract the legs, it is required complicate manufacturing process and high cost to manufacture the stands and the golf bags.

SUMMARY OF THE INVENTION

Therefore, an object of the present invention is to overcome the above-mentioned disadvantages encountered in the prior arts and to provide a golf bag with a support stand wherein movement of its legs between extended and retracted positions is carried out by not an actuating member but upward and downward movements of a case for receiving golf clubs due to weight of the golf clubs so that it allows its manufacturing process and cost to be easy and inexpensive, and its operation to be smooth.

In accordance with the present invention, these objects can be accomplished by providing a golf bag comprising a golf bag body having an opening; a pair of hinge members mounted on a position close to the opening; a pair of legs pivotally mounted on the hinge members at bent ends thereof; a pair of arms which are mounted on the bent ends of the legs at lower ends thereof and have head portions at upper ends thereof, respectively; a pair of connecting links which are connected to the head portions of the arms at one ends thereof and disposed inside of the golf bag body at the other ends thereof; and a case for receiving golf clubs which is fixed to an inner surface of the body at one end thereof and connected to the head portions of the arms at the other end thereof, the other end being movable upwards and downwards.

With accordance to another embodiment of the invention, the golf bag may have a hook mounted on an end of the golf bag and a connecting strap connected to the head portions of the arms at one end thereof and selectively connected to the hook at the other end thereof.

BRIEF DESCRIPTION OF THE DRAWINGS

Other objects and advantages of the present invention will become apparent from the following description of embodiments with reference to the accompanying drawings in which.

DETAILED DESCRIPTION OF THE PREFERRED EMBODIMENTS

Figure 3:
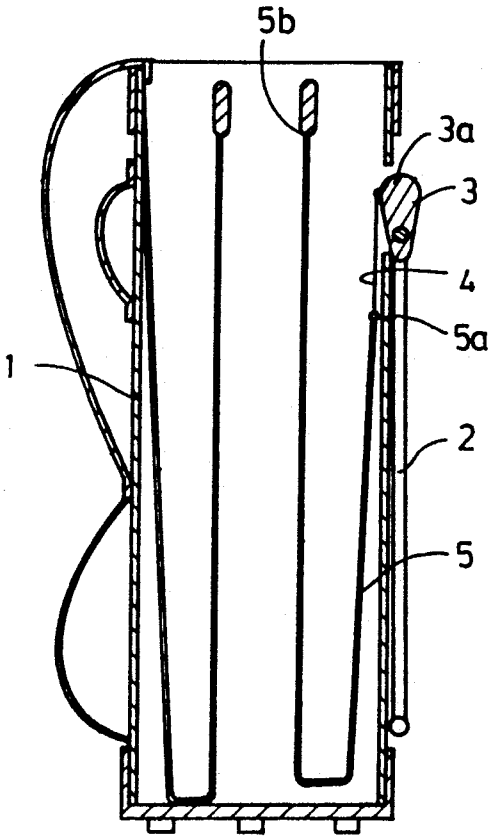
FIG. 3 is a vertical sectional view of the golf bag with stand according to the invention.
Figure 2:
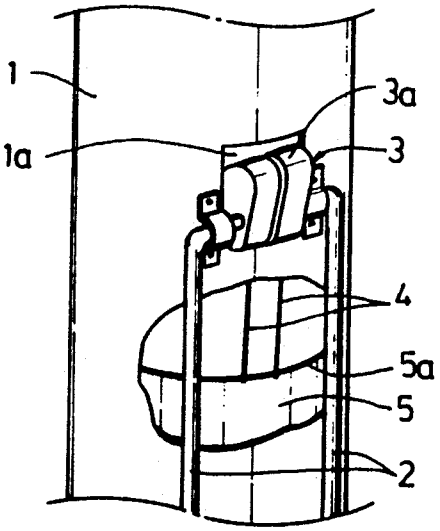
FIG. 2 is an enlarged partial perspective view of the golf bag of FIG. 1, which is partly broken away to show its interior construction.
Figure 1:
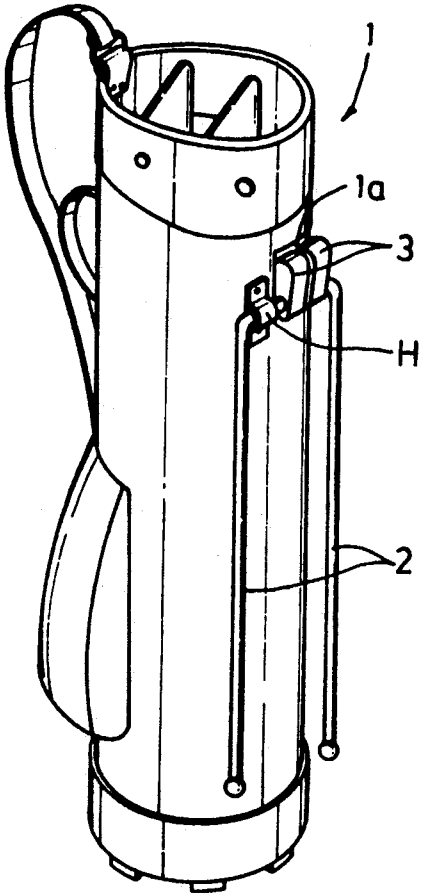
FIG. 1 is a perspective view of a golf bag with stand according to the present invention.

Referring to FIG. 1 , there is shown a golf bag with stand according to the present invention. Referring to FIG. 2, there is shown an operating part of the golf bag shown in FIG. 1. Referring to FIG. 3, there is shown a vertical section of the golf bag of FIG. 1.

As shown in the drawings, the golf bag comprises a golf bag body 1 having an opening 1*a*, a pair of hinge members "H" mounted on a position close to the opening 1*a*, a pair of legs 2 and 2 pivotally mounted on the hinge members "H" at bent ends thereof, a pair of arms 3 and 3 which are mounted on the bent ends of the legs 2 and 2 at lower ends thereof and have head portions 3*a* and 3*a* at upper ends thereof, respectively, a pair of connecting links 4 and 4 which are connected to the head portions 3*a* and 3*a* of the arms 3 and 3 at one ends thereof and disposed inside of the golf bag body 1 at the other ends thereof, and a case 5 for receiving golf clubs which is fixed to an inner surface of the body 1 at one end 5*b* thereof and connected to the head portions 3*a* and 3*a* of the arms 3 and 3 at the other end 5*a* thereof, the other end being movable upwards and downwards.

Operation of the above golf bag with stand will be described hereinafter, with reference to FIGS. 4 to 6.

Figure 4:
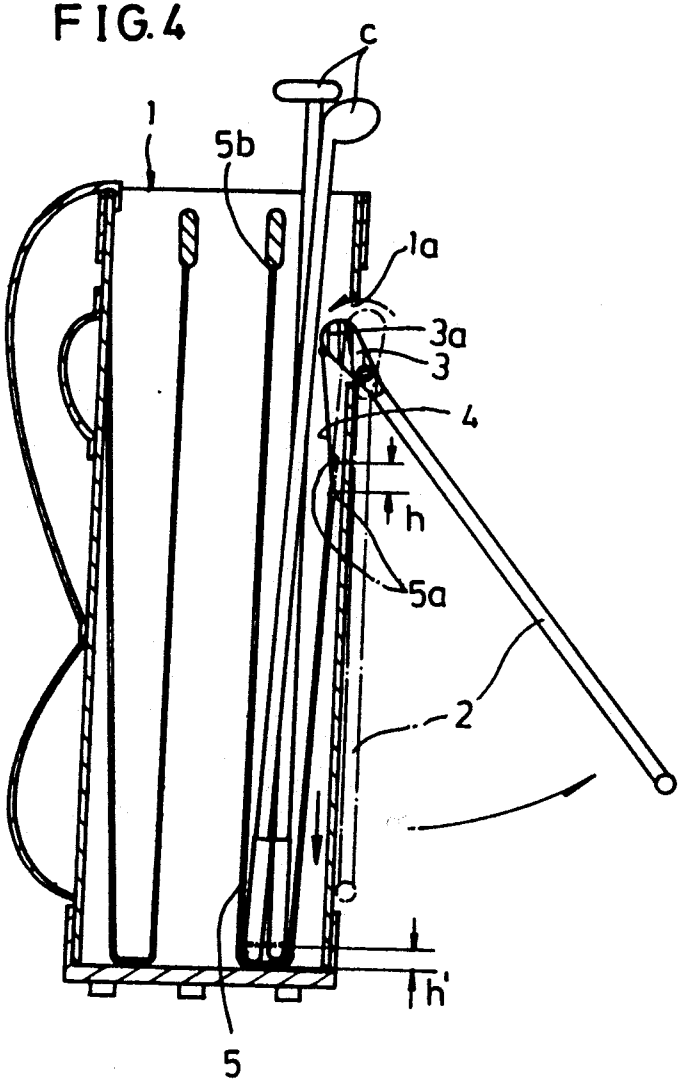
FIG. 4 is a vertical sectional view of the golf bag according to the invention which shows operation of the stand when golf clubs are received therein.

Referring to FIG. 4, there is shown a section of the golf bag showing operation of the legs when golf clubs are received in the golf bag. As shown in the drawing, when golf clubs "C" are received in the case 5, the other end 5*a* of the case "C" which is movable upwards and downwards is moved downwards by a distance "h" by weight of the golf clubs "C" and the bottom of the case 5 is also lowered by a distance "h". Accordingly, the connecting links 4 and 4 connected to the other end 5*a* of the case "C" pull the head portions 3*a* and 3*a* of the arms 3 and 3 inwardly of the golf bag body 1 so that the arms 3 and 3 are pivoted counterclockwise about the hinge members "H" and thus the legs 2 and 2 fixed to the lower ends of the arms 3 and 3 are also pivoted counterclockwise to be extended. Consequently, the head portions 3*a* and 3*a* of the arms 3 are located inside of the golf bag body 1.

Figure 5:
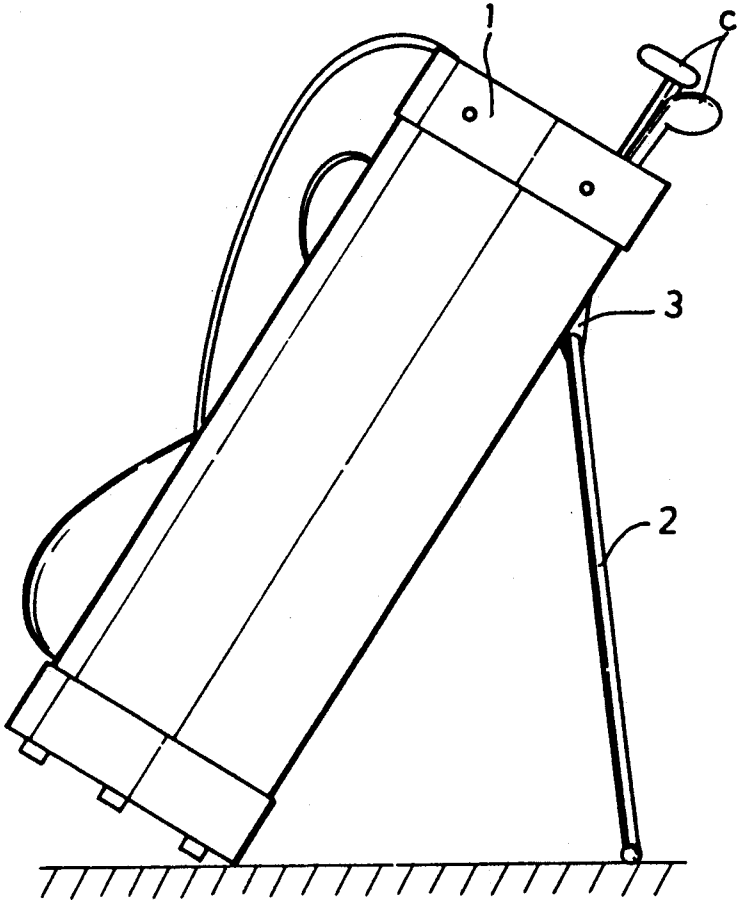
FIG. 5 is a side elevational view of the golf bag of the invention wherein the stand supports the inclined golf bag.

Referring to FIG. 5, there is shown an inclined golf bag of the invention which is supported by the legs. When the legs 2 and 2 are extended as described previously, the golf bag stands stably on a ground if the golf bag is inclined toward the legs 2, as shown in FIG. 5.

Figure 6:
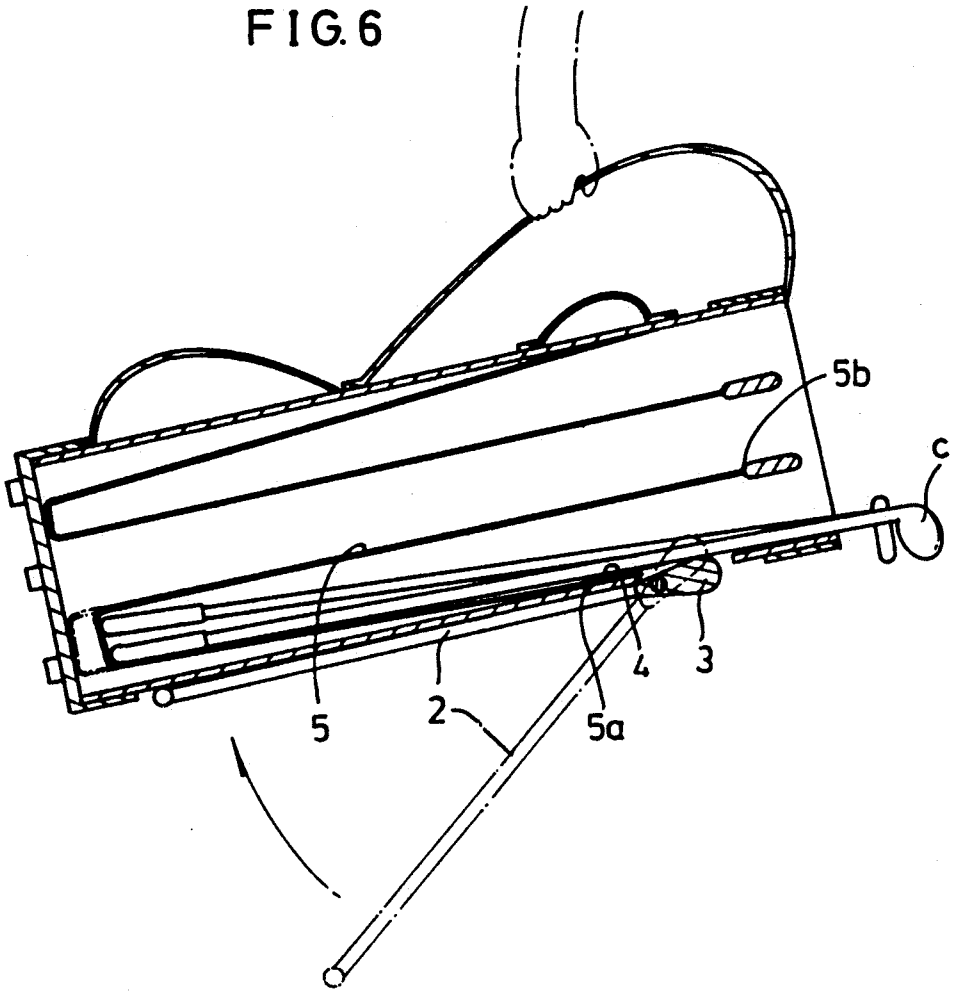
FIG. 6 is a sectional view of the golf bag of the invention showing operation of the stand during its transportation.

Referring to FIG. 6, there is shown the golf bag of the invention during its transportation. If the golf bag is required to be carried and transported, the golf bag is lifted horizontally by an use's hand. Therefore, the arms 3 and 3 pivoted inwardly of the golf bag are pressed by weight of golf clubs "C" at the head portions 3*a* and 3*a* so that the arms 3 and 3 are pivoted clockwise, thereby causing the legs 2 and 2 to be pivoted clockwise and retracted toward outer surface of the golf bag, as shown in FIG. 6. As described above, the golf bag with stand according to the present invention has legs being capable of being automatically extended during its standing and being automatically retracted during its transportation, thereby allowing its use to be convenient.

However, in the first embodiment of the present invention, the golf bag has disadvantage in that the legs are maintained in the condition of being extended if golf clubs are received in the golf bag even when the golf bag is erected for storage, thereby space occupied by the golf bag to be increased.

Figure 7:
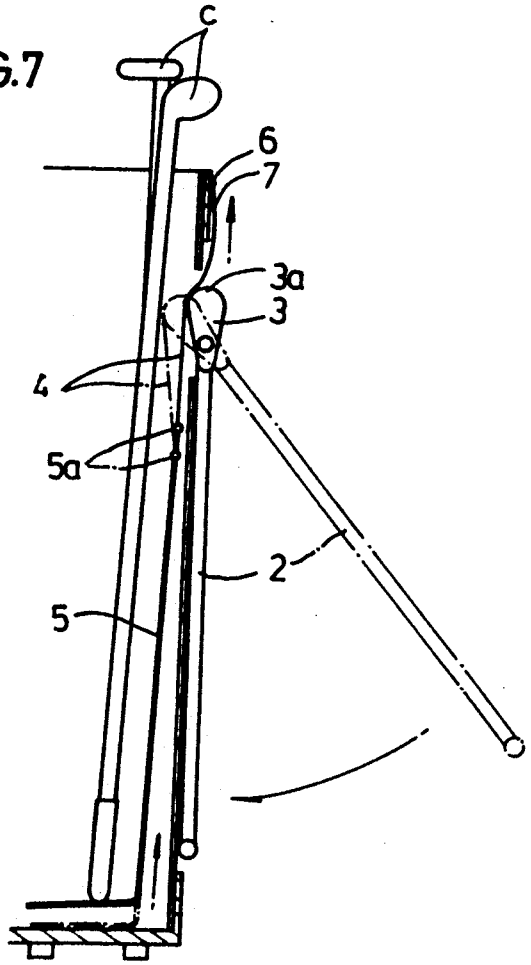
FIG. 7 is a schematic sectional view of other embodiment according to a golf bag with stand of the invention.

Referring to FIG. 7, there is shown another embodiment according to a golf bag of the present invention which is designed to overcome the above disadvantage. The golf bag has additionally hooks 6 fixed to an upper end of the golf bag body 1 and connecting straps 7. The connecting straps 7 are connected to the head portions 3*a* at on ends thereof and selectively connected to the hooks 6 at the other ends thereof. Therefore, when the golf bag receiving golf clubs therein is required to be erected for storage, the connecting straps 7 are pulled upwardly by an user's hand so that the head portions 3*a* located inside of the golf bag are pivoted clockwise, thereby allowing the legs 2 to be retracted. Thereafter, the one ends are connected to the hooks 6 so that the legs 2 are stably maintained in the retracted position without their swings. Accordingly, the golf bag according to the second embodiment of the present invention which receives golf clubs therein can be maintained with the legs being stably retracted even when the golf bag is erected to be stored.

As apparent from the above description, differently from prior golf bags wherein their legs are moved between extended and retracted positions by ascending and descending movement of an actuating member so that the golf bag requires complicate and expensive manufacturing process, the golf bag with stand according to the present invention has an inner case being movable upwards and downwards and legs being extended and retracted by weight of golf clubs received in the golf bag without prior actuating member. Therefore, since the golf bag of the invention has a simple structure, the golf bag is convenient to use and can be manufactured cheaply.

It must be understood that many alterations and modifications may be made by those having ordinary skill in the art to the structures disclosed herein without departing from the spirit and scope of the invention. Therefore, the presently illustrated embodiments have been shown only by way of example and should not be taken to limit the scope of the following claims.

What is claimed is:

1. A golf bag apparatus comprising:

a golf bag body having an opening through a side portion thereof, said opening extending into the interior of said golf bag body;

a hinge arrangement mounted proximate said opening:

a plurality of legs pivotally secured to said hinge arrangement;

at least one arm member having an upper section which is adapted to protrude through said opening into the interior of said golf bag body and a lower section which is mounted to an upper end of said legs;

a golf club case, disposed within the interior of said golf bag body, having a first portion which is fixedly secured to said golf bag body and a second portion which is movable therein; and means for connecting said golf club case and said at least one arm member, said connecting means having a first end portion which is connected to the upper section of each said arm member and a second end portion which is connected to the movable portion of said golf club case.

2. The golf apparatus according to claim 1 further including:

means for removably securing the upper section of each said arm member to an upper portion of said golf bag body, wherein said securing means is adapted to prevent said legs from moving into an extended position.

3. The golf bag apparatus according to claim 2 wherein said securing means further includes:

a hook member mounted to an upper portion of said golf bag body; and a strap member for removably securing the upper section of each arm member to said hook member.

4. A golf bag apparatus comprising:

a golf bag body having an opening through a side portion thereof, said opening extending into the interior of said golf bag body;

a hinge arrangement mounted proximate said aperture;

a plurality of legs, each pivotally secured to said hinge arrangement, said legs having an upper section which is adapted to protrude through said opening into the interior of said golf bag body;

a golf club case, disposed within the interior of said golf bag, having a first portion which is fixedly secured to said golf bag body and a second portion which is movable therein; and means for operatively connecting the movable portion of said golf club case to the upper section of said legs.

5. The golf bag apparatus according to claim 4 further including:

means for removably securing the upper section of said legs to an upper portion of said golf bag body, wherein said securing means is adapted to prevent said legs from moving into an extended position.

6. The golf bag apparatus according to claim 5 wherein said securing means further includes:

a hook member mounted to the upper portion of said golf bag body; and a strap member for removably securing the upper section of said legs to said hook member.

7. A golf bag apparatus comprising:

a golf bag body;

means for pivotally securing a plurality of legs to said golf bag body;

means for supporting at least one golf club within said golf bag body, said golf club supporting means including a first portion which is fixedly secured to said golf bag body and a second portion which is movable therein; and means for operatively connecting the movable portion of said golf club supporting means to an upper section of said legs;

wherein said legs are adapted to be moved between a retracted position and an extended position in response to the weight of the golf clubs within the golf club supporting means.

8. The golf bag apparatus according to claim 7 further including:

means for removably securing the upper section of said legs to an upper portion of said golf bag body, wherein said securing means is adapted to prevent said legs from moving into an extended position.

9. The golf bag apparatus according to claim 8 wherein said securing means further includes:

a hook member mounted to the upper portion of said golf bag body; and a strap member for removably securing the upper section of said legs to said hook member.

* * * * *